US007310851B2

(12) United States Patent
Zhadanov et al.

(10) Patent No.: US 7,310,851 B2
(45) Date of Patent: Dec. 25, 2007

(54) CLEANING DEVICE WITH DISPOSABLE CLEANING ELEMENT

(76) Inventors: Sam Zhadanov, 2944 W. 5th St., Apt. 20J, Brooklyn, NY (US) 11224; Eli Zhadanov, 2944 W. 5th St., Apt. 20J, Brooklyn, NY (US) 11224

( * ) Notice: Subject to any disclaimer, the term of this patent is extended or adjusted under 35 U.S.C. 154(b) by 685 days.

(21) Appl. No.: 10/733,832

(22) Filed: Dec. 12, 2003

(65) Prior Publication Data

US 2005/0125927 A1 Jun. 16, 2005

(51) Int. Cl.
*A47L 11/14* (2006.01)
*A47L 13/10* (2006.01)
*A47L 13/20* (2006.01)

(52) U.S. Cl. ..... 15/230.19; 15/230.14; 15/230; 15/209.1; 15/1.7; 15/147.1; 451/359

(58) Field of Classification Search ..... 15/230, 15/230.14, 230.16, 230.19, 28, 29, 97.1, 15/1.7, 209.1, 210.1, 147.1; 451/353, 359, 451/495

See application file for complete search history.

(56) References Cited

U.S. PATENT DOCUMENTS 1,673,160 A * 6/1928 Ross ..... 15/230.18
1,908,355 A * 5/1933 Preston ..... 451/510
2,119,738 A * 6/1938 Dempsey ..... 451/511
3,195,537 A * 7/1965 Blasi ..... 601/114
4,530,125 A * 7/1985 Hofmann ..... 15/1.7
5,465,443 A * 11/1995 Rice et al. ..... 15/246
5,784,748 A * 7/1998 Belanger et al. ..... 15/230.14
5,842,250 A * 12/1998 Zhadanov ..... 15/230.14

* cited by examiner

*Primary Examiner*—Gary K. Graham
(74) *Attorney, Agent, or Firm*—I. Zborovsky

(57) ABSTRACT

A cleaning device has a cleaning element having an axis, an axial inner region and an axial outer region and being formed so that at least the axially outer region is bendable to follow a shape of a surface to be cleaned when pressed against the surface, a holding element which is substantially more rigid than the cleaning element so as to hold the cleaning element, and a connecting element which releasably connects the cleaning element to the holding element so that after use of the cleaning element the cleaning element can be disconnected from the holding element and removed, to install in the cleaning device a new cleaning element or to clean a used cleaning element and to install it in the cleaning device again.

11 Claims, 2 Drawing Sheets

CLEANING DEVICE WITH DISPOSABLE CLEANING ELEMENT

BACKGROUND OF THE INVENTION

The present invention relates generally to cleaning devices which can be used as a mitt, a mop head, an attachment to water cleaning systems, etc.

Cleaning devices of the above mentioned general type are known in the art. Known cleaning devices are usually formed as disks. One of such known devices is disclosed in our U.S. Pat. No. 5,842,250. In the known cleaning devices when the cleaning element becomes dirty, the whole device becomes inoperative and cannot be used again. It is believed that this device can be further improved.

SUMMARY OF THE INVENTION

Accordingly, it is an object of the present invention to provide a cleaning device which is a further improvement of the existing cleaning devices.

In keeping with these objects and with others which will become apparent hereinafter, one feature resides, briefly stated, in a cleaning device which has a cleaning element having an axis, an axial inner region and an axial outer region and being formed so that at least said axially outer region is bendable to follow a shape of a surface to be cleaned when pressed against the surface; a holding element which is substantially more rigid than said cleaning element so as to hold said cleaning element; and a connecting element which releasably connects said cleaning element to said holding element so that after use of said cleaning element said cleaning element can be disconnected from said holding element and removed.

When the cleaning device is designed in accordance with the present invention, the cleaning element after use can be easily removed from the holding element, and then can be replaced by a new cleaning element, or cleaned and again installed in the cleaning device for further use.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
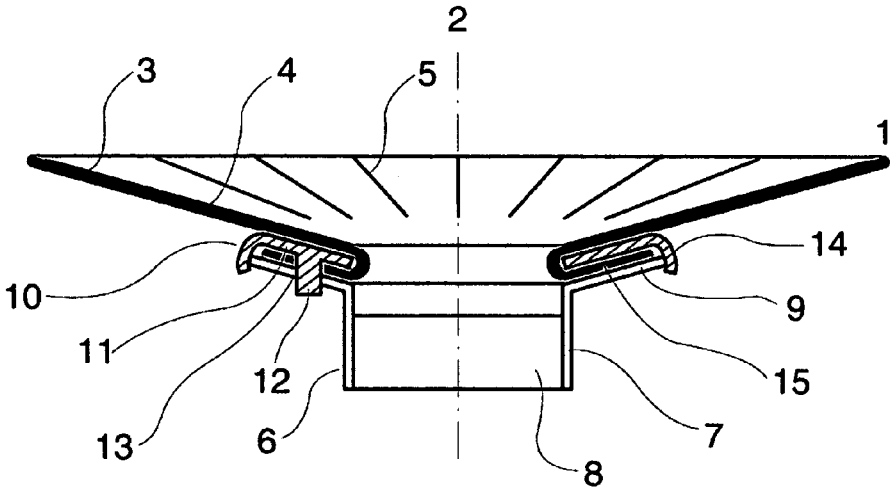
FIG. 1 is a view showing a cross-section of a cleaning device in accordance with the present invention.

A cleaning device in accordance with the present invention has a cleaning element which is identified as a whole with reference numeral 1. The cleaning element 1 is formed substantially as a disc having a central axis 2. The cleaning element 1 has an axially outer region 3 and an axially inner region 4 with respect to the axis 2. At least the axially outer region 3 is elastic so that it can follow a shape of a surface to be cleaned when pressed against the surface. For this purpose at least the axially outer region 3 can be provided with a plurality of slots 5 which can extend from an outer circumferential edge of the cleaning element 1 toward the axis 2.

The cleaning device further has a holding element which is identified as a whole with reference numeral 6. The holding element 6 is provided with a central portion 7 which is preferably tubular and has a central throughgoing opening 8, and also has a peripheral portion 9. The peripheral portion 9 can be substantially conical. The holding element 6 is designed to hold the cleaning element 1. In particular, the peripheral portion 9 of the holding element 6 holds the axially inner region 4 of the cleaning element 1. The holding element 6 is substantially more rigid than the cleaning element 1, to provide an adequate holding action.

The cleaning device in accordance with the present invention further has a connecting element which is identified as a whole with reference numeral 10. The connecting element 10 is designed so that it releasably holds the cleaning element 1 on the holding element 6 so that the cleaning element 1 after use can be released from the holding element 6 and removed, and thereafter a new cleaning element can be again attached to the holding element 6 or the same cleaning element can be cleaned and again attached to the holding element. In the shown embodiment the connecting element 10 has a portion which is identified with reference numeral 11. The portion 11 of the connecting element 10 directly contacts the axially inner region 4 of the cleaning element 1 and is located between the axially inner region 4 of the cleaning element 1 and the peripheral portion 9 of the holding element 6.

The connecting element 10 has projection means which is identified with reference numeral 12. The projection means 12 can be formed by a plurality of projections which are spaced from one another in a circumferential direction and located at a certain radial distance or distances from the axis 2. The portion 9 of the holding element 6, in turn, is provided with opening means 13, with which the projection means 12 are engageable. The opening means 13 can be formed by a plurality of throughgoing openings which are similarly spaced from one another in a circumferential direction and located at a certain radius or radii from the axis 2. The connecting element 10 further has a annular rim 14 which extends transversely to the portion 11 and can be flexible.

As can be seen from FIG. 1, the cleaning element 1 has an additional portion 15 which can be bent over the connecting element 10 to extend in an opposite direction along the axially inner region 4 between the portion 11 of the connecting element 10 and the portion 9 of the holding element 6. In order to allow bending of the portion 15, it is provided for example with a plurality of slots 16 extending from the center of the cleaning element 1, in an initial position of the cleaning element, radially outwardly.

Figure 2:
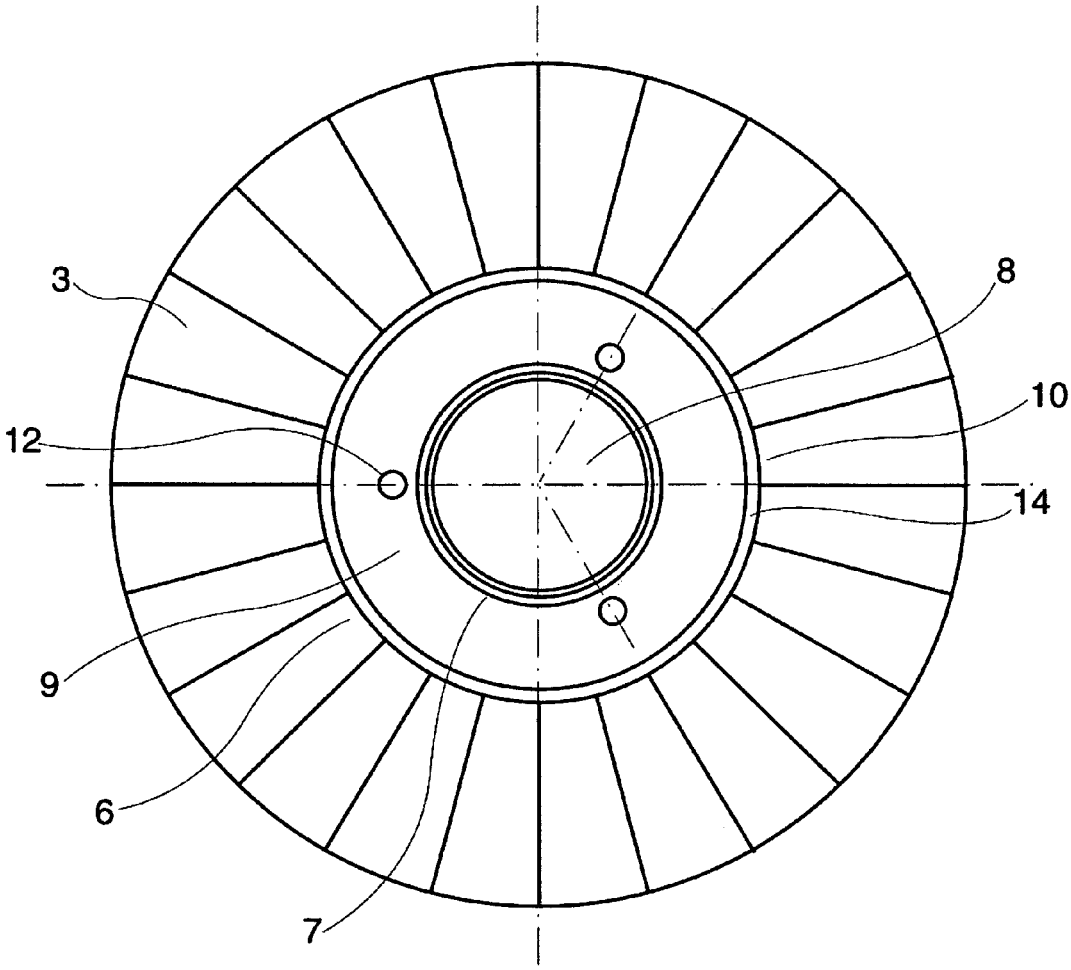
FIG. 2 is a bottom view of the cleaning device in accordance with the present invention.
Figure 3:
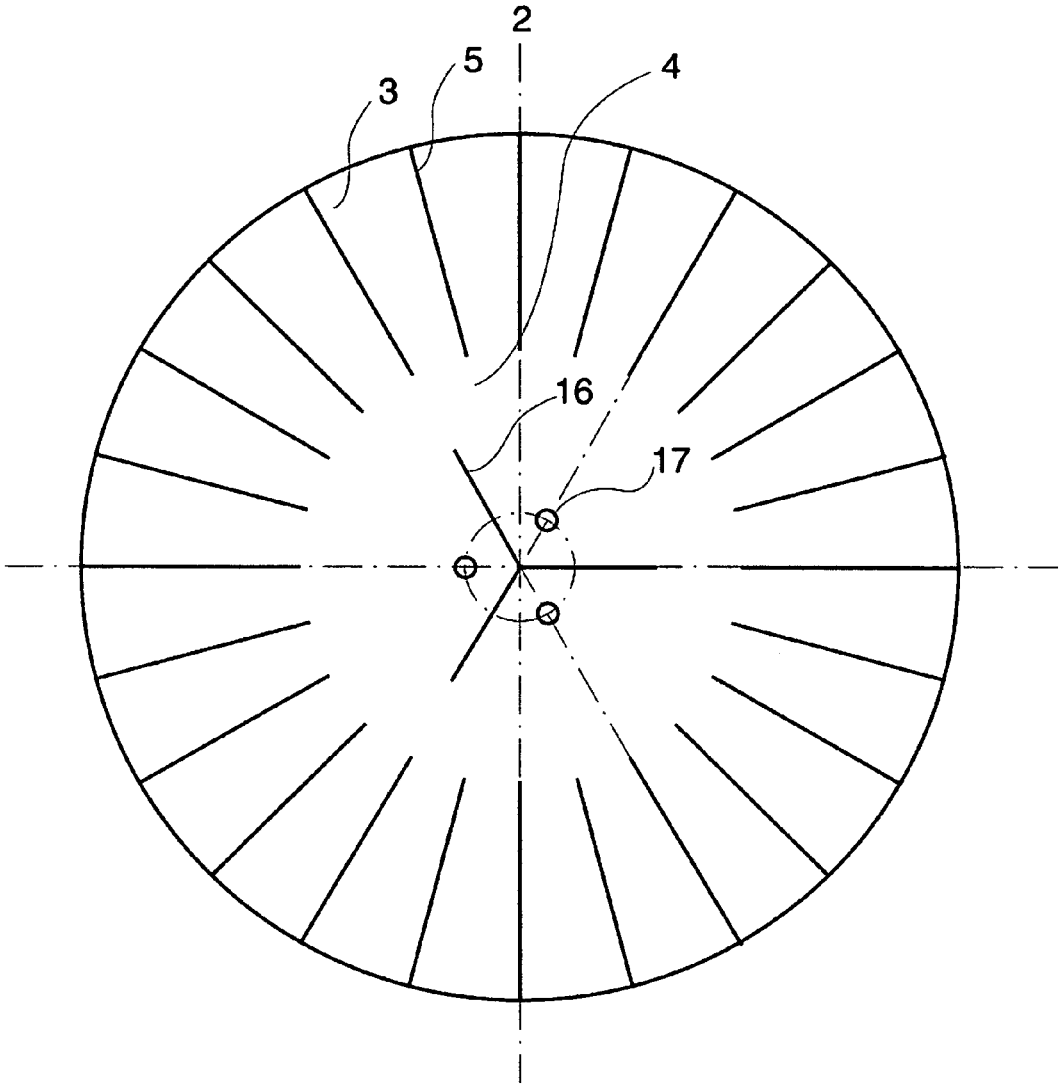
FIG. 3 is a view showing a cleaning element in its initial position.

The cleaning element 1, and in particular its portion 15 is provided with opening means which can include a plurality of openings 17 substantially corresponding to the openings 13 of the portion 9 of the holding element 6. As can be seen from FIG. 2, in the initial position of the cleaning element 1 it can be formed as a flat disc provided with the axially outer region 3, the axially inner region 4, the portion 15, the slots 16 and the openings 17.

In order to assemble the device, the portion 15 of the cleaning element 1 is bent as shown in FIG. 1, around the portion 11 of the connecting element 10 so that the projections 12 of the connecting element 10 extend through the openings 17 of the cleaning element 1. Then the projections 12 are passed through the openings 13 of the portion 9 of the holding element 6 and the rim 14 engages over the outer peripheral edge of the portion 9 of the holding element 6, for example with snap action, thus providing a complete assembly of the cleaning device.

After a corresponding use and dirtying of the cleaning element 1, it can be removed from the cleaning device by pulling the cleaning element 1 together with the connecting element 2 from the holding element 6 so that the rim 14 of the connecting element 2 disengages from the peripheral edge of the holding element 6. Then the cleaning element 1 is removed from the projections 12 of the connecting element 10. A new cleaning element 1 can then be attached to the connecting element 2 and connected with the holding element 6 in a reversed order. It is also possible to clean dirtied cleaning element 1, and then to attach it to the connecting element and connect with the holding element, to use it again.

It will be understood that each of the elements described above, or two or more together, may also find a useful application in other types of constructions differing from the types described above.

While the invention has been illustrated and described as embodied in a cleaning device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cleaning device, comprising a cleaning element having an axis, an axial inner region and an axial outer region and being formed so that at least said axially outer region is bendable to follow a shape of a surface to be cleaned when pressed against the surface; a holding element which is substantially more rigid than said cleaning element so as to hold said cleaning element; and a connecting element which releasably connects said cleaning element to said holding element so that after use of said cleaning element said cleaning element can be disconnected from said holding element and removed, to install in the cleaning device a new cleaning element or to clean a used cleaning element and to install it in the cleaning device again, wherein said cleaning element has an additional portion extending from said axially inner region and bent from said axially inner region to extend in a substantially opposite direction, said additional portion being located between said holding element and said connecting element.

2. A cleaning device as defined in claim 1, wherein said holding element is formed so as to hold said cleaning element substantially in said axially inner region.

3. A cleaning device as defined in claim 1, wherein said holding element has a central portion provided with a throughgoing opening for supplying a liquid therethrough and a peripheral portion formed to support said cleaning element in said axially inner region.

4. A cleaning device as defined in claim 1, wherein said connecting element is engageable with said holding element so as to hold said connecting element and said holding element together in an assembled condition of the cleaning device.

5. A cleaning device as defined in claim 1, wherein said connecting element has a peripheral rim which engages over a peripheral edge of said holding element with a snap action.

6. A cleaning device as defined in claim 1, wherein said holding element and said connecting element have projection means provided on one of said holding elements and said connecting element, and opening means provided on the other of said holding element and connecting element and in which said projection means is engageable.

7. A cleaning device as defined in claim 6, wherein said opening means include a plurality of openings provided on said other element, while said engaging means include a plurality of projections provided in said one element and engaging in said openings.

8. A cleaning device as defined in claim 7, wherein said cleaning element is provided with a plurality of openings through which said projections extend.

9. A cleaning device as defined in claim 7, wherein said elements have a central axis, said projections and said openings being distributed circumferentially around said central axis at angular distances from one another.

10. A cleaning device as defined in claim 1, wherein said additional portion of said cleaning element is provided with slot means allowing bending of said additional portion.

11. A cleaning device as defined in claim 10, wherein said slot means include a plurality of slots extending in a direction from an axis of the cleaning device substantially radially outwardly.

* * * * *